United States Patent [19]

Gaizauskas

[11] 4,268,729

[45] May 19, 1981

[54] PLUG AND RECEPTACLE INTERLOCK

[75] Inventor: Bronius Gaizauskas, Chicago, Ill.

[73] Assignee: Akzona Incorporated, Asheville, N.C.

[21] Appl. No.: 71,816

[22] Filed: Sep. 4, 1979

[51] Int. Cl.[3] ..... H01H 9/20

[52] U.S. Cl. ..... 200/50 B; 200/51 R; 339/91 R

[58] Field of Search ..... 200/50 B, 51 R; 339/91 R

[56] References Cited

U.S. PATENT DOCUMENTS

| | | | |
|---|---|---|---|
| 1,818,290 | 8/1931 | Wulle | 200/50 B |
| 1,971,990 | 8/1934 | Reynolds et al. | 200/50 B |
| 3,523,166 | 8/1970 | Daly | 200/50 B |

*Primary Examiner*—J. V. Truhe
*Assistant Examiner*—Morris Ginsburg
*Attorney, Agent, or Firm*—Francis W. Young; David M. Carter

[57] ABSTRACT

There is provided an improved interlock mechanism for a plug and receptacle. The receptacle houses an electrical circuit breaker which controls the power to a set of contacts in the receptacle. A pair of spring biased ears are mounted on the outside of a barrel portion of the receptacle which receives the plug and locks the plug to the receptacle. A pair of rods are mechanically coupled to the circuit breaker and adapted to be received in corresponding holes in the ears when the plug is in the receptacle and the power is switched on. However, when the plug is not in the receptacle, these rods will abut against a solid surface on the ears during an attempt to switch the power on. Thus, power may be switched on only when the plug is received in the receptacle; furthermore, the plug may not be retracted while the power is on.

15 Claims, 7 Drawing Figures

PLUG AND RECEPTACLE INTERLOCK

BACKGROUND OF THE INVENTION

This invention relates to an improved electrical connector. More particularly, it relates to an improved interlock system for a plug and receptacle which houses an electrical switch.

For electrical connections in high current applications such as shipboard and/or dockside, it is quite often necessary to insure that one side of the line is deactivated while the contacts are exposed and during engagement and disengagement of the connector. This deactivation of power is to prevent arcing when the corresponding contacts of the plug and the receptacle of the connector are either engaged or disengaged with one another, and further, to provide a safety factor for personnel who may be in close proximity to the receptacle when the plug is removed, especially at wet locations. Arcing is bothersome because it causes corrosion of the contacts and, furthermore, in certain situations, such as certain gaseous environments, this arcing could cause an explosion.

Prior art attempts to overcome these problems include the use of a circuit breaker or electrical switch within the receptacle. A handle is placed on the outside of the receptacle, which must be turned to its off position prior to retraction or insertion of a corresponding plug. Thus, the switch opens the circuit between the receptacle contact and the high voltage conductor on the power source side of the switch. The main drawback of this device is that it is subject to human error, in that the person doing the connecting might forget to switch off the power prior to connecting/disconnecting the plug. Others have attempted to overcome this human error problem by the use of so called interlock systems.

One example of an interlock technique is shown in U.S. Pat. No. 1,934,024, issued to Anderson. The Anderson patent shows a junction box, which includes a receptacle and an electrical switch. A corresponding plug is adapted to be received in the receptacle. A rod is operably connected to the junction box switch, which is further connected to a latching device. The latching device latches to a boss on the outer periphery surface of the plug, which locks the plug into place when the power is turned on. By the use of this latch the power must be turned off in order for the plug to be removed. Thus, arcing is substantially eliminated upon withdrawal of the plug. However, one of the drawbacks of the Anderson patent is that the power may be turned on after the plug has been removed from the receptacle. Thus, the contacts of the receptacle may be tampered with the switch on, causing a safety hazard.

Another interlocked plug and receptacle is disclosed in U.S. Pat. No. 2,015,543, issued to Bissell. The Bissell patent shows a switch which is housed by the receptacle and operated by a handle on the receptacle. The handle is attached to a switching drive mechanism by a rod. When the plug is removed from the receptacle, a lock member maintains the rod in one position, i.e., the switch is kept off. However, once the plug has been inserted into the receptacle, the lock member rotates permitting the switch to be turned on. One of the drawbacks to the Bissell construction is that the lock member is internal to the receptacle and appears to be susceptible to jamming. Thus, it is impossible to see whether or not interlock mechanism is working to maintain the switch off when the plug is removed.

OBJECTS OF THE INVENTION

It is one object of this invention to provide an improved plug and receptacle system.

It is another object to provide a safe and reliable interlock system for a receptacle housing an electrical switch.

It is another object to provide an improved plug and receptacle which minimizes the possibility of power being on the receptacle contacts while the plug is removed therefrom.

It is a further object to provide a plug and receptacle system which insures that the power is only on the receptacle contacts when mated to the plug.

It is still another object of this invention to provide a plug and receptacle system which includes an improved interlock to prevent the plug from being retracted from the receptacle while the power is on.

SUMMARY OF THE INVENTION

In accordance with one form of this invention, there is provided an electrical connector including a plug and receptacle each including electrical contacts. The plug is adapted to mate with the receptacle. An electrical switch, which may be a circuit breaker, is housed in the receptacle and controls the power to the contacts in the receptacle. At least one ear, with a hole therein, is rotatably mounted on the receptacle. A rod is coupled to the switch. A portion of the ear is adapted to abut against the rod and prevent the power from coming on when the plug is not in the receptacle. The ear is rotated by a camming action during insertion of the plug, causing the hole in the ear to align with the rod. Furthermore, when the power is turned on, the hole in the ear receives the rod and the ear interlocks with the plug to prevent the plug from being retracted from the receptacle when the power is on.

BRIEF DESCRIPTION OF THE DRAWINGS

The subject matter which is regarded as the invention is set forth in the appended claims. The invention itself, however, together with further objects and advantages thereof, may be better understood by reference to the following description taken in conjunction with the accompanying drawings in which:

DESCRIPTION OF THE PREFERRED EMBODIMENT

Figure 1:
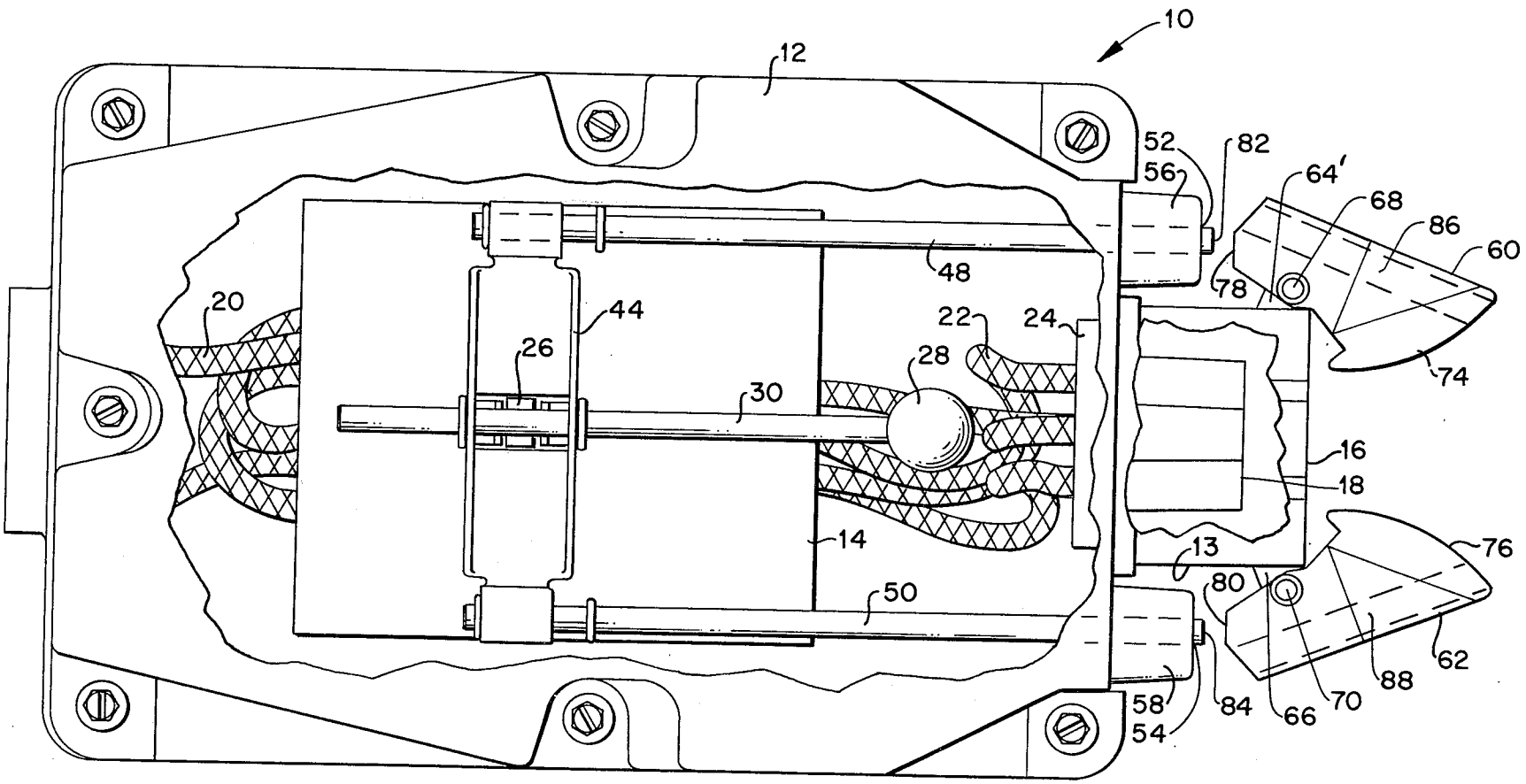
FIG. 1 is a top view of a receptacle of the subject invention with the top of the receptacle removed.

Referring now more particularly to FIG. 1, there is provided receptable 10, which includes switch housing 12 and plug inlet cylinder 13. Switch housing 12 encloses switch 14 which, in one embodiment, is a General Electric TED-134030 circuit breaker. Plug inlet cylinder 13 houses electrical contacts 18 which, in this embodiment, are female contacts. Switch 14 couples wires 20 to wires 22 when it is closed. Wires 22 are further coupled to the female contacts 18 through insulating insert 24. The wires 20 are connected to a source of 3-phase power, and thus present high voltage to that side of switch 14. Toggle 26 of the switch is mounted to the top of switch box 14, and is moved laterally to control the transfer of electrical energy from wires 20 to wires 22. Handle 28, which is mounted on the outside of the receptacle housing, is coupled to toggle 26 through rod 30. This may be better seen in reference to FIG. 2.

A pair of hook-shaped plates 32 and 34 are coupled to rod 30, and alternately make contact with toggle 26. As handle 28 is moved by hand in the rearward direction, plate member 34 forces toggle 26 in the rearward direction, thus turning off the switch 14. As switch handle 28 is pulled in the forward direction, plate member 32 forces toggle 26 in the forward direction, and turns on switch 14. Rod 30 is mounted in the housing through holes in embossments 36 and 38. The switch 14 is mounted in the housing by screws (not shown) in embossments 40 and 42. Hook-shaped plate members 32 and 34 are also coupled to plate 44, which slides along with rod 30. Plate 44 is further perpendicularly coupled to plates 46, which are, in turn, connected to a pair of rods 48 and 50. Rods 48 and 50 also slide along parallel with rod 30. Rods 48 and 50 extend through the holes 52 and 54 in embossments 56 and 58.

Figure 2:
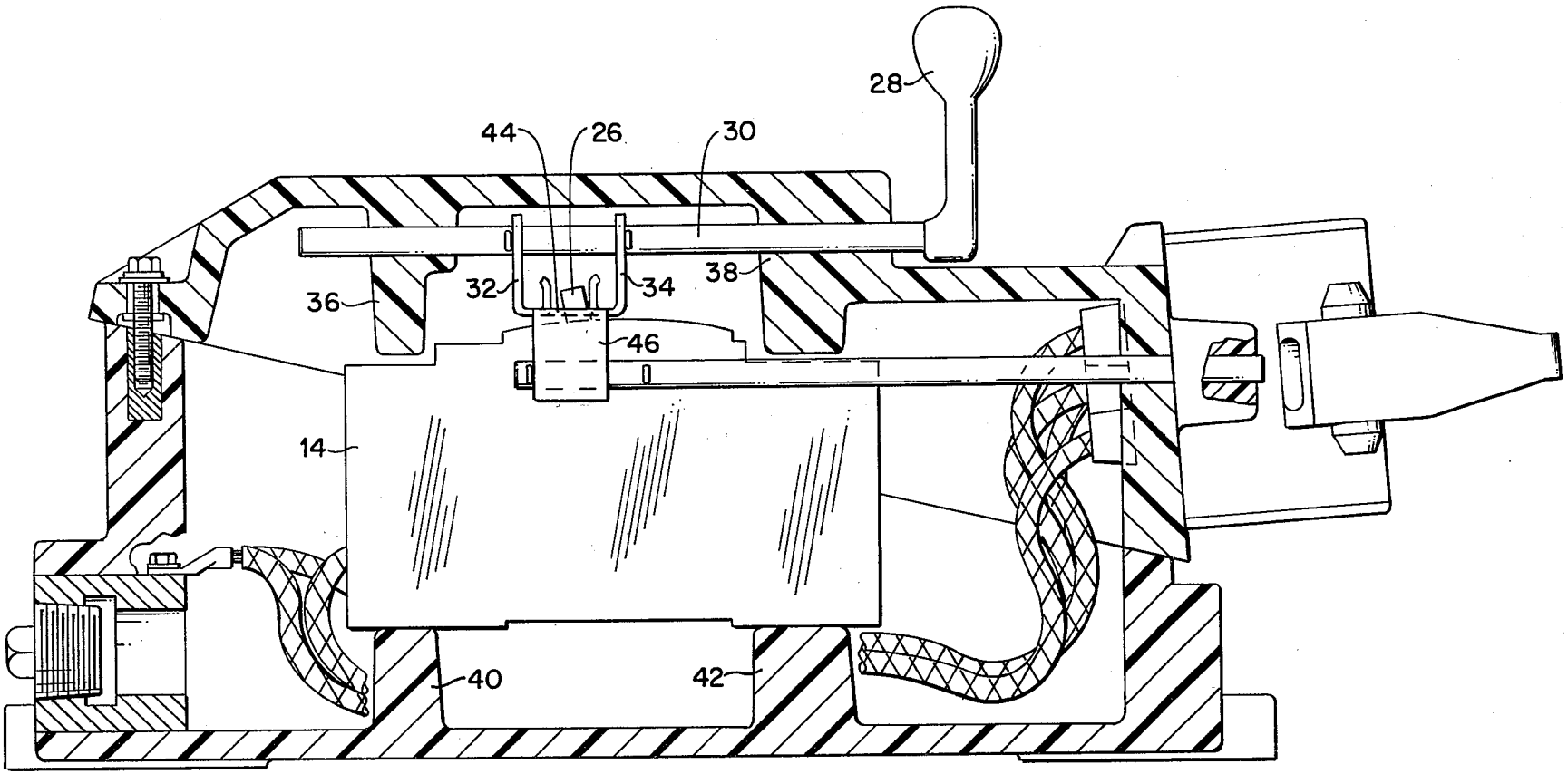
FIG. 2 is a side elevational view of the receptacle of FIG. 1 with the side removed.
Figure 3:
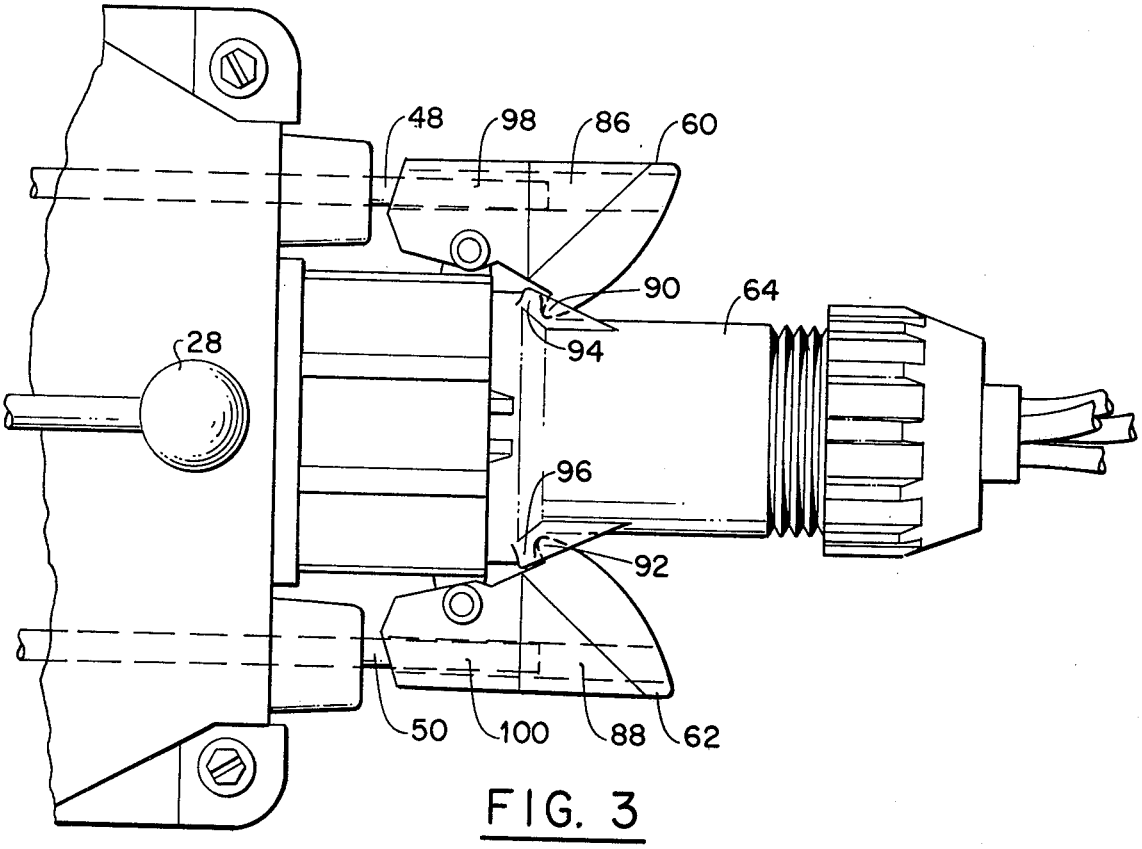
FIG. 3 is a partial top view of the receptacle of FIG. 1 having a corresponding plug inserted therein.

FIGS. 1 and 2 show the switch in the off position, and thus no power is applied to contacts 18. As will be explained below, rods 48 and 50 interreact with rotatably-mounted ears 60 and 62 to maintain the switch 14 off, unless a corresponding plug 64, as shown in FIG. 3, is inserted therein. Furthermore, the rods help to interlock the plug 64 to the receptable 10.

Ears 60 and 62 are mounted on the barrel of receptable 13 by studs 64' and 66. Pins 68 and 70 secure the ears to the studs, and thus to the barrel of the receptable.

Figure 6:
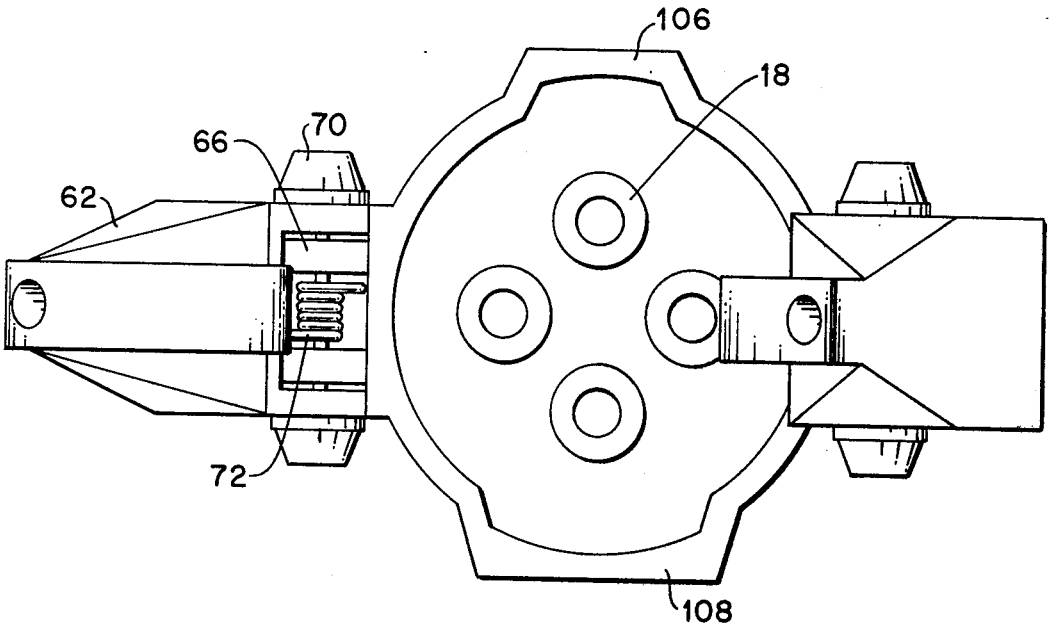
FIG. 6 is a partial front view of the receptacle of FIG. 1 with the locking ear pulled out to show its spring.
Figure 7:
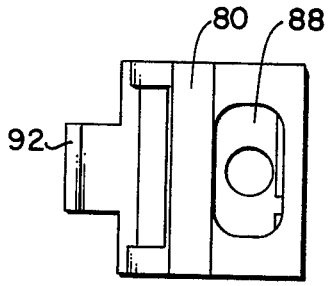
FIG. 7 is a pictorial view of one of the locking ears of FIG. 1.

A pair of springs are mounted about the pins 68 and 70, which is illustrated in FIG. 6, as spring 72. These springs bias the ears inwardly, as shown in FIG. 1, so that the cammed portions 74 and 76 of the ears partially block the opening 16 of the receptable barrel 13.

The illustration in FIG. 6 shows the ears 62 having been pulled open by hand so that the spring 72 is shown for illustrative purposes only. However, normally in its rest position, i.e., with the plug 64 not inserted in the receptable, the ears will be forced inwardly as illustrated in FIG. 1. With the ears in the position shown in FIG. 1, solid abutments of the ears 78 and 80 align with rods 48 and 50, thus the ends of the rods 82 and 84 will strike abutments 78 and 80 if one tries to pull handle 28 forward in an attempt to turn on the switch 14 without the plug 64 having been inserted in the receptacle. The gap between the ends of the rods and the abutment of the ears is small enough such that the toggle 26 does not travel far enough to turn on the switch 14. In this manner, this receptacle device will not permit power to be applied to female contacts 18 when the contacts are not engaged with the plug in the receptable.

Figure 5:
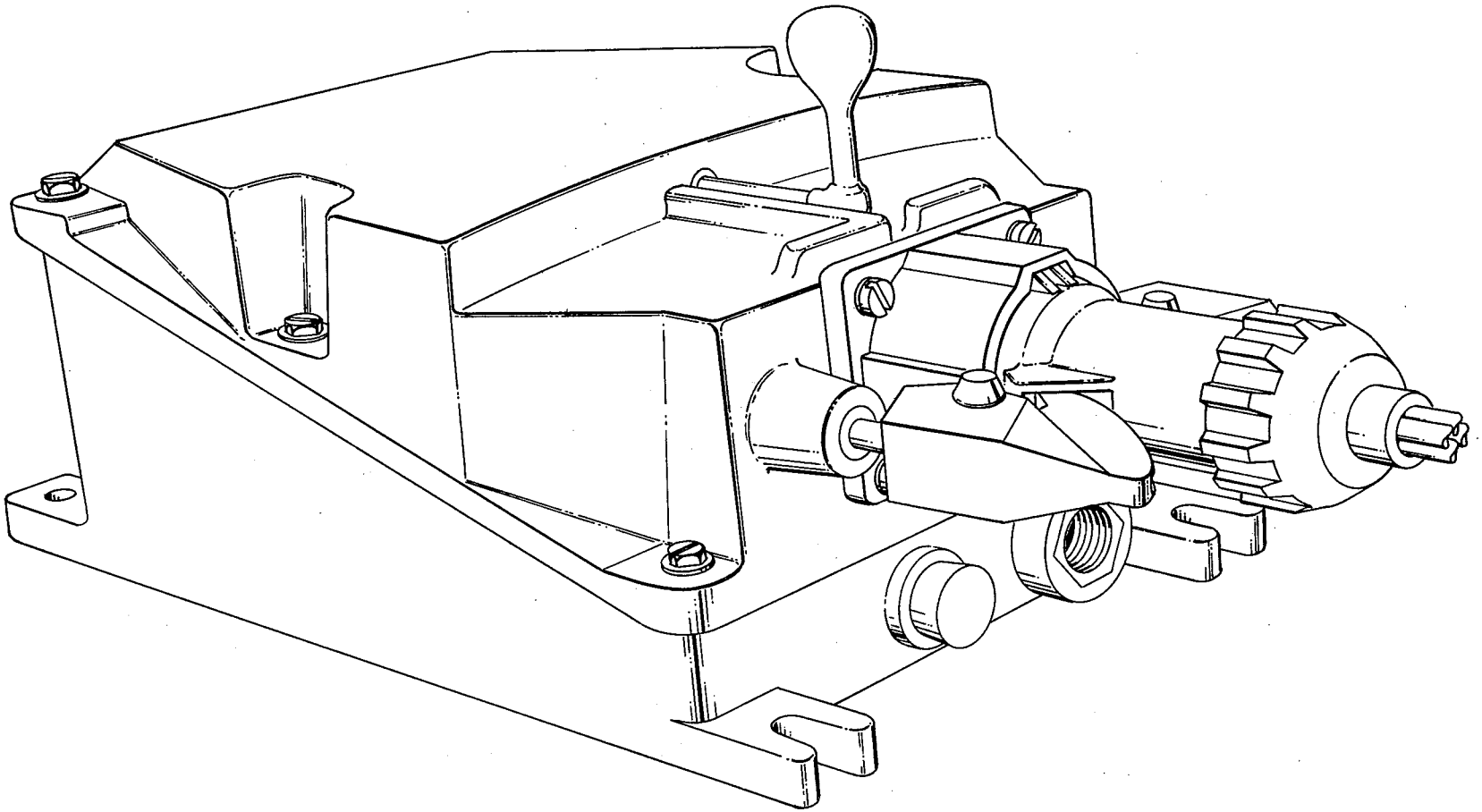
FIG. 5 is a pictorial view of the plug and receptacle of the subject invention.

As stated previously, the surface 74 of the ears is cammed, or curved in shape. As shown in FIG. 5, this permits a plug to be smoothly received in between the two cam surfaces 74 and 76, urging the ears to the open position, as the plug is inserted into the receptacle 13. With the plug in the receptacle as shown in FIG. 3, ears 60 and 62 are opened and biased against their springs 72. When the plug is in the receptacle, the openings 86 and 88, which are holes drilled through the ears, become respectively aligned with rods of 48 and 50. When handle 28 is pulled forward, the rods 48 and 50 are received in holes 86 and 88, thus no longer abutting against surfaces 78 and 80. The toggle 26 is also moved fully forward, causing the switch 14 to come on, thus providing power to electrical contacts 18. Thus, the plug must be firmly inserted into the receptacle before the power is permitted to be switched on so that arcing will not occur during insertion.

Figure 4:
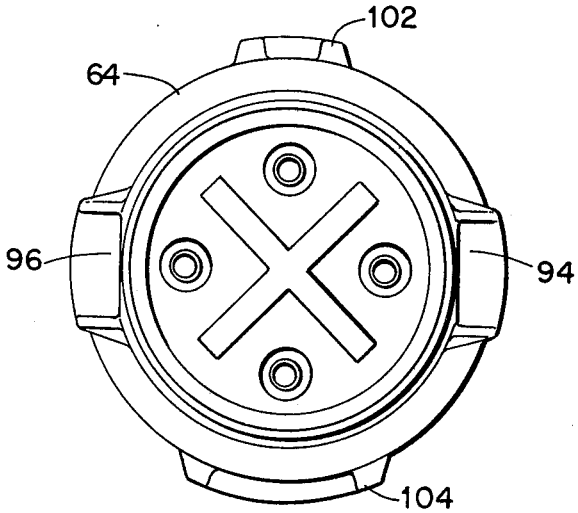
FIG. 4 is a rear elevational view of the plug shown in FIG. 3.

Furthermore, the plug is locked into the receptacle, while the power is on, and can only be removed after the handle 28 has again been pressed rearward, switching the power off. This interlocking is accomplished by the cooperation of rods 48 and 50, inserted into the holes and the latch tips, 90 and 92, which extend from the ends of the cammed portions of 74 and 76 of the ears. These latch tips are curved inwardly to fit into slots 94 and 96 of plug 64. The slots may also be seen in FIG. 4, which is a rear-end view of plug 64. These slots and latch tips prevent the plug from being pulled out of the receptable unless the ears could be opened even further. Since the rods 48 and 50 are in the "on" position inside the holes 86 and 88, it is, of course, quite impossible to open the ears any further since the rod ends 98 and 100 would abut against the sides of the holes.

To remove the plug 64 from the receptacle, the switch handle 28 must be pressed rearward, thus throwing the toggle and turning off the electrical switch 14. This removes the power from contacts 18, and further, removing the rods 48 and 50 from the holes in the ears. The ears may now be opened further by hand against the spring pressure, and thus removing the latch fingers 90 and 92 from slots 94 and 96. By holding the ears open, one is then able to pull the plug from the receptacle. Of course, the power is off, thus there is no possibility of arcing when the plug contacts are separated from the receptacle contacts.

The plug further has key members 102 and 104, which align with key members 106 and 108 of the receptacle, so that the proper contacts are mated.

With the ears mounted on the outside of the receptacle, one may easily repair and adjust the interlock mechanism and see the condition of the interlock, i.e., if the ears have been tampered with.

Furthermore, with the holes drilled through the ears all the way through to the cammed surfaces 74 and 76, ice or other foreign matter may be removed therefrom easily, by poking a screw driver or other sharp instrument through the holes.

Thus, it may be seen that an improved mechanically interlocked plug and receptacle is provided, such that power cannot be turned on to the receptacle contacts unless the plug is fully inserted and mated with the contacts of the receptacle. Also, the plug cannot be removed from the receptacle unless such power has been turned off. This, of course, alleviates the problem of arcing between contacts, and further, alleviates the safety hazard which existed when power could be turned on while the plug is out of the receptacle.

From the foregoing description of the preferred embodiment of the invention, it will be apparent that many modifications may be made therein. It will be understood that this embodiment of the invention is intended as an exemplification of the invention only, and that the invention is not limited thereto. It is to be understood, therefore, that it is intended, in the appended claims, to cover all such modifications which fall within the true spirit and scope of the invention.

We claim:

1. An electrical connector comprising:

a plug and a receptacle, each including electrical contacts, said receptacle including a housing, said housing enclosing an electrical switch;

at least one ear member mounted on said housing and adapted to engage said plug when said plug is inserted into said receptacle, said ear member having a hole drilled therein and an abutting surface thereon;

a rod mechanically coupled to said switch, said rod moving in tandem with switch movement, said rod aligned with and adapted to be received in the hole in said ear when said plug is received in said receptacle enabling said switch to be turned on, said rod aligned with and adapted to abut against said abutting surface when said plug is not received in said receptacle thus not permitting said switch to be turned on.

2. An electrical connector comprising:

a plug and a receptacle, each including electrical contacts, said plug adapted to mate with said receptacle;

an electrical switch housed by said receptacle, said electrical switch controlling the power on the contacts of the receptacle;

a switch actuation handle;

at least one ear rotatably mounted on said receptacle;

a rod linked to said switch and to said switch actuation handle, a portion of said ear adapted to abut against said rod when said plug is not in said receptacle, preventing said switch from being actuated; said ear having a hole drilled therein; said rod aligned with and adapted to be received in the hole when the plug is received in said receptacle enabling said switch to be turned on.

3. An electrical connector as set forth in claim 2, wherein said ear is mounted on the outside of said receptacle, said rod penetrating said receptacle.

4. An electrical connector as set forth in claim 2, wherein said ear is spring biased inwardly.

5. An electrical connector as set forth in claim 2, wherein said ear is adapted to latch onto said plug.

6. An electrical connector as set forth in claim 2, wherein the inner portions of the said ear is cam shaped for receiving said plug, and cammed outwardly as said plug is inserted into said receptacle.

7. An electrical connector as set forth in claim 2, further including a latch finger extending from said ear, said latch finger adapted to engage said plug and hold said plug in said receptacle.

8. An electrical connector as set forth in claim 2, further including a second ear substantially identical to the other ear mounted on said receptacle.

9. An electrical connector comprising:

a plug and a receptacle, each including electrical contacts, said plug adapted to mate with said receptacle;

an electrical switch housed by said receptacle, said electrical switch controlling the power on the contacts of said receptacle;

at least one ear mounted on said receptacle, said ear including an abutment surface and a hole drilled at least part of the way therethrough;

a rod coupled to said switch, said rod aligned with and adapted to abut against said abutment surface of said ear when said plug is not engaged with said receptacle, thereby preventing the power from being placed on the receptacle contacts; and said rod aligned with and adapted to be received in said hole of said ear when said plug is inserted in said receptacle, thereby permitting power to be placed on the receptacle contacts.

10. An electrical connector as set forth in claim 9, further including an actuation handle mechanically ganged to said switch for turning said switch off and on.

11. An electrical connector as set forth in claim 9, further including a cam surface on said ear for contacting and cooperating with the plug during insertion thereof to move the abutment surface of said ear away from alignment into said rod and to move the hole into alignment with said rod when said plug is fully inserted.

12. An electrical receptacle comprising:

a housing, said housing enclosing an electrical switch, at least a first pair of electrical leads connecting said switch to a power source;

at least a second pair of electrical leads connecting said switch to at least a pair of electrical contacts;

an opening in said housing for permitting a plug to be connected to the contacts of said receptacle;

at least one ear rotatably connected to said housing;

a rod coupled to said switch and having a portion extending to the outside of said housing, said rod being in a first position when said switch is on, and a second position when said switch is off;

an abutting surface on said ear, said rod aligned with and adapted to abut against said abutting surface in an attempt to turn on said switch without the plug being inserted in said receptacle, thereby preventing the switch from coming on;

a hole being in said ear adapted to be aligned with said rod when the plug is inserted in said receptacle, said rod received in said hole when said rod is in first position, thereby permitting said switch to turn on.

13. An electrical receptacle as set forth in claim 12, further including a latch finger extending from said ear and adapted to hook onto the plug, thereby preventing the plug from being removed from the receptacle when the power is on.

14. A receptacle as set forth in claim 12, further including a spring coupled to said receptacle and to said ear for biasing the ear in such a position so that the rod is adapted to be aligned with said abutting surface when the plug is out of the receptacle.

15. An electrical connector comprising:

a plug and a receptacle, said receptacle including a housing and a barrel member, said housing enclosing an electrical switch, said barrel member enclosing a plurality of electrical contacts, said contacts being connected to said switch, said switch further being connected to a source of electrical energy;

a handle external to said housing coupled to said switch;

a pair of rods further coupled to said switch and being controlled by said handle, said rods having a portion extending to the outside of said housing;

a pair of ears coupled to said barrel member, said ears each including an abutment surface thereon and a hole therein, said ears further each including a cam surface for coming in contact with said plug during insertion;

a pair of spring members coupled to said ears biasing said cam surfaces inwardly toward one another; said plug coming in contact with said cam surfaces of said ears and urging said cam surfaces away from each other while said plug is being inserted into said barrel member; when said plug is fully inserted into said barrel member, said holes aligning with said rods; said holes receiving said rods when said handle is pulled in one direction, thus turning on said switch, said ears each including latch members engaging said plug for holding said plug into said receptacle.

* * * * *